US006074994A

United States Patent [19]

Gunsel et al.

[11] Patent Number: 6,074,994

[45] **Date of Patent: *Jun. 13, 2000**

[54] NON-AQUEOUS SOLVENT-FREE LAMELLAR LIQUID CRYSTALLINE LUBRICANTS

[75] Inventors: Selda Gunsel, The Woodlands, Tex.; Fran Lockwood, Georgetown, Ky.

[73] Assignee: Pennzoil Products Company, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/795,194

[22] Filed: Feb. 4, 1997

Related U.S. Application Data

[63] Continuation of application No. 08/729,252, Oct. 10, 1996, abandoned.

[51] Int. Cl.[7] ..... C10M 105/72; C10M 105/74

[52] U.S. Cl. ..... 508/410; 508/412; 508/436

[58] Field of Search ..... 508/410, 412, 508/436

[56] References Cited

U.S. PATENT DOCUMENTS

| | | | |
|---|---|---|---|
| 3,793,199 | 2/1974 | Schlicht | 508/436 |
| 3,897,349 | 7/1975 | Marin et al. | 508/412 |
| 3,979,308 | 9/1976 | Mead et al. | 508/436 |
| 4,231,883 | 11/1980 | Malec | 508/412 |
| 4,781,849 | 11/1988 | Biresaw et al. | 252/49.5 |
| 4,999,122 | 3/1991 | Lockwood et al. | 252/32.5 |
| 5,064,546 | 11/1991 | Dasai | 508/436 |
| 5,080,813 | 1/1992 | Kammann, Jr. et al. | 508/436 |
| 5,320,766 | 6/1994 | Habeeb et al. | 508/436 |
| 5,320,767 | 6/1994 | Habeeb | 508/412 |
| 5,410,424 | 4/1995 | Konuma et al. | 359/51 |
| 5,498,358 | 3/1996 | Kim et al. | 252/57.5 A |
| 5,656,582 | 8/1997 | Shiraishi et al. | 508/410 |

FOREIGN PATENT DOCUMENTS

| | | |
|---|---|---|
| 0 092 682 A1 | 11/1983 | European Pat. Off. . |
| 195 43 185 A1 | 5/1997 | Germany . |
| 58-001129 | 1/1983 | Japan . |
| 7-082582 | 9/1993 | Japan . |
| 6-128582 | 5/1994 | Japan . |
| 1 692 814 | 11/1991 | U.S.S.R. . |
| WO 98/15605 | 4/1998 | WIPO . |

OTHER PUBLICATIONS

K.J. Chugg et al., "Boundary lubrication and shear properties of thin solid films of dioctadecyl dimethyl ammonium chloride (TA100)", Journal of Physics D: Applied Physics, vol. 26, No. 11, Nov. 14, 1993, pp. 1993–2000.

*Primary Examiner*—Jerry D. Johnson
*Attorney, Agent, or Firm*—McDermott, Will & Emery

[57] ABSTRACT

Non-aqueous solvent-free lamellar liquid crystalline lubricant compositions containing an organic acid component or a salt thereof and an organic acid component are disclosed.

15 Claims, No Drawings

NON-AQUEOUS SOLVENT-FREE LAMELLAR LIQUID CRYSTALLINE LUBRICANTS

This application is a continuation application of Ser. No. 08/729,252 filed Oct. 10, 1996 now abandoned.

TECHNICAL FIELD

The present invention relates to non-aqueous lamellar liquid crystalline compositions which are useful as lubricants and as friction modifiers in lubricating oil compositions owing to their advantageous combination of physical properties. More particularly, the present invention relates to non-aqueous lamellar liquid crystalline compositions which comprise an organic acid component or a salt thereof and an organic amine component but are free of non-aqueous solvent.

BACKGROUND ART

U.S. Pat. No. 4,999,122 discloses liquid crystalline compositions which include a non-aqueous solvent which is necessary to maintain the liquid crystalline properties of the composition. The present invention is based, in part, on the surprising and unexpected discovery of liquid crystalline compositions which are useful as lubricants and as friction modifiers but are free of a non-aqueous solvent.

SUMMARY OF THE INVENTION

Accordingly, it is an object of the present invention to provide novel lamellar liquid crystalline compositions and, more particularly, to provide non-aqueous lamellar liquid crystalline compositions which are useful as lubricants or as friction-modifying additives in lubricating oil compositions.

It is an additional object of the present invention to provide non-aqueous lamellar liquid crystalline compositions which maintain liquid crystallinity over a broad temperature range.

It is a further object of the invention to provide lamellar liquid crystal compositions which exhibit low viscosity-pressure coefficients.

These and additional objects are provided by the non-aqueous lamellar liquid crystalline compositions of the present invention. The present compositions comprise an organic acid component or a salt thereof and an organic amine component which forms a liquid crystal with the acid or salt thereof. The compositions are free of non-aqueous solvent. The organic acid component preferably is a long chain acid selected from the group consisting of alkyl phosphoric acids, aryl phosphoric acids, alkyl sulfonic acids and aryl sulfonic acids. The weight ratios of the components are such that the compositions exhibit lamellar liquid crystalline properties, the weight ratio of the organic acid to organic amine being in the range of about 1:1 to about 5:1. The components may be varied within these parameters in order to adjust the viscosity, transition temperature and/or solubility toward additives while maintaining the liquid crystalline phase.

These and additional objects and advantages will be more fully understood in view of the following detailed description.

DETAILED DESCRIPTION OF THE INVENTION

The non-aqueous lamellar liquid crystalline compositions according to the present invention comprise an organic acid component or a salt thereof and an organic amine component but are free of non-aqueous solvent. The organic acid and the amine create an amphophilic salt having hydrophobic and hydrophilic parts. Only certain ratios of the acid or salt and the amine provide stable liquid crystalline compositions.

The organic acid component comprises a long chain acid and preferably is selected from the group consisting of alkyl phosphoric acids, aryl phosphoric acids, alkyl sulfonic acids, and aryl sulfonic acids. The organic acid component may be replaced by a salt of one of the recited acids. Preferably, the alkyl group which is included in the alkyl phosphoric acid or alkyl sulfonic acid comprises at least six carbon atoms, and, more preferably, comprises from 6 to about 20 carbon atoms. The aryl acids and salts thereof may include one or more aromatic rings.

The amine component may be any mono-, di- or tri-amine which forms a liquid crystalline structure with the organic acid or salt thereof. Preferred amines include triethanolamine diethanolamine and ethanolamine, ethyldiethanol amine and analogous amines, long chain amines such as tallow amine or any of its amine components suchasn-dodecyl-1,3-diaminopropane, n-oleyl-1,3-diaminopropane, n,n-dimethylaminothioethers, and the like. A preferred amine component comprises tallow amine.

As set forth above, only certain ratios of the acid or salt thereof and the amine afford stable liquid crystalline compositions. Thus, it is important that the weight ratios of these two components are controlled such that the composition exhibits lamellar liquid crystalline properties. The ratio of organic acid or salt thereof to amine should be in the range of about 1:1 to about 5:1. Preferably, the weight ratio of the acid or salt thereof to the amine is in the range of about 1:1 to about 3:1.

The non-aqueous lamellar liquid crystalline compositions are prepared by mixing the organic acid component and organic amine component. Then, the other additives such as oxidation inhibitors, extreme pressure agents, corrosion inhibitors and the like may be mixed in the compositions.

The liquid crystalline compositions of the invention are advantageous in that they maintain their liquid crystallinity over a broad temperature range. Additionally, their viscosities, transition temperatures and solubility toward additives may be adjusted by varying the acid/amine ratio while maintaining the liquid crystalline phase. The-compositions exhibit improved normal stresses in shear flow, in some case up to two orders of magnitude greater than conventional fluids. The liquid crystal compositions exhibit low viscosity-pressure coefficients and are shear thinning. Owing to these properties, the fluid film friction of the compositions is low, particularly as compared with conventional fluids under increasing shear and/or increasing pressure conditions. The compositions exhibit low to extraordinarily low friction under slow sliding conditions and comparisons with commercial fluids and greases of comparable viscosity indicated that the liquid crystal compositions exhibited vastly reduced friction. In view of these properties, the liquid crystal compositions are useful as lubricants in many applications.

Additionally, the liquid crystal compositions are useful as friction-modifying additives in lubricating oil compositions. Such lubricating oil compositions may comprise mineral oil, synthetic oil or mixtures thereof. Preferably, the friction modifier comprising the non-aqueous lamellar liquid crystalline material of the present invention is included in such lubricating compositions in an amount of from about 0.1 to about 5 weight percent.

The following example demonstrates several non-aqueous lamellar liquid crystalline compositions according to the present invention:

EXAMPLES

Non-aqueous lamellar liquid crystalline compositions according to the present invention were prepared comprising dodecylbenzene sulfonic acid and tallow amine.

The compositions were prepared by weighing the components into glass vials and mixing with a Vortex vibromixer. In particular, a first composition (composition P-1) was prepared by mixing dodecylbenzene sulfonic acid and tallow amine such that the weight ratio of the acid to the amine was 2:1. A second composition (composition P-2) was prepared by mixing dodecylbenzene sulfonic acid and tallow amine such that the weight ratio of the acid to the amine was 1:1. The compositions were analyzed for liquid crystalline structure by optical microscopy using cross-polarizing lenses.

Slow sliding experiments were performed on a homemade rig in which a 52100 steel ball of 1.28 cm diameter was slid back and forth across a 52100 steel flat of 0.02 micron finish. Temperature was ambient and humidity was 60–800. The calculated average Hertz pressure at a load of 100 g was 0.27 GPa. The test was performed at 100 g load; however, in some cases, the load was varied up to 500 g (0.46GPa). The sliding speed was 2.54 cm/min. For the purpose of making viscosity and film thickness calculations a shear rate in the contact zone was calculated, assuming a typical thickness EHD film of 0.1 to 1.0 micron. The calculated shear rate range of 210 to 2100 sec-; was then used in evaluating the viscosities of the non-Newtonian fluids studied. Rheological measurements were performed on a cone and plate mechanical spectrometer with a cone radius of 1.25 cm and angle of 0.1 radian. Shear rate was varied from 25 to 2500 sec-; and temperature was maintained at 295–296 K. Shearing time was held at 5 seconds to prevent viscous heating. The friction coefficient reported is a steady state value. As can be seen, liquid crystal compositions P-1 keep P-2 showed extraordinarily low friction. The results of this test are shown in Table 1.

Film thickness calculations, reported in Table 2, were performed by the method of Foord et al. in Optical Elastohydrodynamics, Proc. J. Mech. E., 184, Pt. 1 No. 28 (1969). These calculations are approximate since the LC viscosity is shear rate dependent and the shear rate in the contact zone is difficult to estimate. Film parameters (i.e., the ratio of film thickness to composite surface roughness) are also reported in Table 2.

TABLE 1

SLOW SLIDING FRICTION COEFFICIENTS OF LIQUID CRYSTALS

| Liquid Crystal | Friction Coefficient | Viscosity (p)** | Isotropic Transition Temp(° C.) |
|---|---|---|---|
| P-1 | 0.020 | 346.0 | 165 |
| F-2 | 0.060 | 145.0 | 56 |
| | 0.070 | 0.2 | 60.6 |
| Halocarbon Grease | 0.16 | 540.0 | |

N — Nematic Liquid Crystal

*Steady state repeated passes in slow (2.5 cm/min) sliding, ball on flat, ambient, 52100 steel, Ra - 0.02 $\mu$m, −70% humidity, 0.27 GPa hertz pressure.

**Measured at 1000 $sec^{-1}$ and ambient temperature.

TABLE 2

CALCULATED FILM THICKNESS FOR LIQUID CRYSTAL AND HALOCARBON GREASE IN THE SLOW SLIDING EXPERIMENT

| Material | Shear Rate ($s^{-1}$) | Viscosity (p) | Viscosity-Pressure Coefficient ($Pa^{-1}$) | Film Thickness $\mu$ | Film Parameter |
|---|---|---|---|---|---|
| P-1 | 250 | 1800 | $5 \cdot 10^{-9}$ | 0.1 | 3.5 |
| | | | $2 \cdot 10^{-8}$ | 0.3 | 8.7 |
| | 1000 | 350 | $5 \cdot 10^{-9}$ | 0.04 | 1.3 |
| | | | $2 \cdot 10^{-8}$ | 0.08 | 2.9 |
| | 2500 | 125 | $5 \cdot 10^{-9}$ | 0.2 | 0.6 |
| | | | $2 \cdot 10^{-8}$ | 0.04 | 1.5 |
| Halo- | 250 | 1930 | $6 \times 10^{-8}$ | 0.50 | 17.7 |
| carbon | 1000 | 540 | $6 \times 10^{-8}$ | 0.2 | 7.5 |
| Grease | 2500 | 240 | $6 \times 10^{-8}$ | 0.1 | 4.4 |

Film parameters indicate that the lubrication regime in the slow sliding test is "mixed film". Film thickness calculated for the halocarbon grease indicate that this material should produce an elastohydrodynamic regime and thicker films than the P-1 liquid crystal.

However, it produced very high friction; 0.16. This may be due to its high viscosity-pressure coefficient. This material may undergo glass transition during the sliding experiment which would cause high friction. The low viscosity-pressure coefficients of the liquid crystals are beneficial for producing low friction. Table 3 shows additional slow sliding friction test results.

TABLE 3

SLOW SLIDING FRICTION TEST RESULTS

| Sample | Friction Coefficient |
|---|---|
| Paraffin Oil | stick-slip |
| Paraffin Oil + 2.0% P-1 | 0.125 |
| 10W-30 Motor Oil | 0.150 |
| 10W-30 Motor Oil + 2.0% P-1 | 0.135 |
| P-1 | 0.020 |
| Test Conditions: | Steady state repeated passes in slow (2.5 cm/min) sliding, 52100 steel, ball on disc, ambient temperature, Ra = 0.02 $\mu$m, −70% humidity, 0.27 GPa Hertz Pressure |

The preceding examples set forth to illustrate specific embodiments of the invention and are not intended to limit the scope of the presently claimed compositions. Additional embodiments and advantages within the scope of the claimed invention will be apparent to one of ordinary skill in the art.

What is claimed is:

1. A non-aqueous liquid lubricant composition exhibiting lamellar liquid crystalline properties, said composition consisting of:

(a) an organic acid component selected from the group consisting of alkyl phosphoric acids, aryl phosphoric acids, alkyl sulfonic acids, aryl sulfonic acids, and salts thereof; and (b) an organic amine component;

wherein the non-aqueous lubricant composition does not contain a non-aqueous organic solvent and wherein the weight ratio of components (a) and (b) is in the range of about 1:1 to about 5:1; said composition further consisting of at least one additive selected from the group consisting of oxidation inhibitors, corrosion inhibitors and extreme pressure agents.

2. A non-aqueous liquid lubricant composition as defined in claim 1, wherein the acid component includes an alkyl group having from 6 to 20 carbon atoms.

3. A non-aqueous liquid lubricant composition as defined in claim 2, wherein the acid component comprises dodecylbenzene sulfonic acid.

4. A non-aqueous liquid lubricant composition as defined by claim 1, wherein the amine component is selected from the group consisting of ethanolamine, diethanolamine, triethanolamine, ethyldiethanol amine, tallow amine, n-dodecyl-1,3-diaminopropane, n-oleyl-1,3-diaminopropane and n,n-dimethyl aminothioethers.

5. A non-aqueous liquid lubricant composition as defined by claim 4, wherein the amine component comprises tallow amine.

6. A non-aqueous liquid lubricant composition as defined by claim 1, wherein the weight ratio of components (a) and (b) is in the range of about 1:1 to about 3:1.

7. A non-aqueous liquid lubricant composition as defined by claim 6, wherein the amine component is tallow amine.

8. A lubricating composition comprising:

a friction modifier formed of a non-aqueous lamellar liquid crystalline material comprising (a) an organic acid component selected from the group consisting of alkyl phosphoric acids, aryl phosphoric acids, alkyl sulfonic acids, aryl sulfonic acids, and salts thereof; and (b) an organic amine component;

wherein said lamellar liquid crystalline material does not contain a non-aqueous organic solvent and wherein the weight ratio of components (a) and (b) is in the range of about 1:1 to about 5:1; said composition further including at least one additive selected from the group consisting of oxidation inhibitors, corrosion inhibitors and extreme pressure agents.

9. A non-aqueous liquid lubricant composition exhibiting lamellar liquid crystalline properties, said composition consisting essentially of:

(a) an organic acid component selected from the group consisting of alkyl phosphoric acids, aryl phosphoric acids, alkyl sulfonic acids, aryl sulfonic acids, and salts thereof; and (b) an organic amine component;

wherein the non-aqueous liquid lubricant composition does not contain a non-aqueous solvent and wherein the weight ratio of components (a) and (b) is in the range of about 1:1 to about 5:1; said composition further consisting essentially of at least one additive selected from the group consisting of oxidation inhibitors, corrosion inhibitors and extreme pressure agents.

10. A non-aqueous liquid lubricant composition as defined in claim 9, wherein the acid component or salt thereof includes an alkyl group having from 6 to 20 carbon atoms.

11. A non-aqueous liquid lubricant composition as defined in claim 10, wherein the acid component comprises dodecylbenzene sulfonic acid.

12. A non-aqueous liquid lubricant composition as defined by claim 9, wherein the amine component is selected from the group consisting of ethanolamine, diethanolamine, triethanolamine, ethyldiethanol amine, tallow amine, n-dodecyl-1,3-diaminopropane, n-oleyl-1,3-diaminopropane and n,n-dimethyl aminothioethers.

13. A non-aqueous liquid lubricant composition as defined by claim 12, wherein the amine component comprises tallow amine.

14. A non-aqueous liquid lubricant composition as defined by claim 9, wherein the weight ratio of components (a) and (b) is in the range of about 1:1 to 3:1.

15. A non-aqueous liquid lubricant composition as defined by claim 14, wherein the amine component is tallow amine.

* * * * *